United States Patent [19]

Lewis et al.

[11] 4,047,413

[45] Sept. 13, 1977

[54] AUTOMATIC METAL-SPINNING METHOD

[76] Inventors: Burton F. Lewis, Bear Hill Road; Alan Y. Lewis, Walnut St., both of Hillsboro, N.H. 03244

[21] Appl. No.: 649,907

[22] Filed: Jan. 16, 1976

[51] Int. Cl.[2] ..... B21D 22/14

[52] U.S. Cl. ..... 72/83; 72/85; 72/377; 29/159 R

[58] Field of Search ..... 72/82, 83, 85, 377; 29/38 A, 38 B, 159 R; 82/3

[56] References Cited

U.S. PATENT DOCUMENTS

| | | | |
|---|---|---|---|
| 2,960,951 | 11/1960 | Bierman | 72/83 |
| 3,046,924 | 7/1962 | Kane | 113/52 |
| 3,109,400 | 11/1963 | Paulton | 72/83 |
| 3,137,259 | 6/1964 | Sporch | 72/83 |
| 3,203,316 | 4/1965 | Cashman et al. | 82/3 X |
| 3,282,078 | 11/1966 | Kaesemeyer | 72/82 |
| 3,490,258 | 1/1970 | Patchell | 72/83 X |
| 3,946,585 | 3/1976 | Caboni | 72/83 |

*Primary Examiner*—Leon Gilden
*Attorney, Agent, or Firm*—Thomas N. Tarrant

[57] ABSTRACT

An automatic metal-spinning machine utilizing a plurality of work spindles, which rotate on their own axes, adjacent respective parallel spinning-tool operating shafts rotatable with variable pressure to apply tools against workpieces on the spindles while all simultaneously and continuously rotate around a central column so that a plurality of metal blanks are progressively formed and several parts are completed as the spindles and tool operating shafts make one revolution around the central column.

4 Claims, 5 Drawing Figures

AUTOMATIC METAL-SPINNING METHOD

BACKGROUND OF THE INVENTION:

1. Field of the Invention:

The present invention relates to metal-spinning machines and in particular to such machines that operate on a plurality of workpieces simultaneously.

2. Description of the Prior Art:

Prior art automatic metal-spinning machines have commonly consisted of a single work spindle in which the disc of metal to be worked on is positioned on the spindle by hand and then a device is actuated to clamp the workpiece against the spindle for rotation. The operator stands by, while the spinning process is performed by slide-mounted tools, and then manually releases the workpiece, removing it from the spindle in order to insert the next workpiece. Although it is also possible for one machine operator to operate several single spindle automatic spinning machines, the cost of the equipment, the floor space required, and the machine handling equipment involved, far exceeds that of the machine herein described.

A particular problem that has restricted machine designers in producing multiple-spindle metal-spinning machines has been the need for providing a practical, compact means for controlling the forming tools in producing parts of varying shapes.

Single spindle machines have been arranged with template controls or other devices that control movement of slide-mounted tools along two axes or by positioning the travel relation of a tool slide to match the straight taper when conical parts are being made.

Although such means have proven satisfactory for much of the work being produced by single spindle machines, the cost involved and the amount of mechanism required has made such arrangements impractical for incorporation into a multiple-spindle machine.

SUMMARY OF THE INVENTION

In accordance with the present invention, a multiple-spindle metal-spinning machine is provided for automatically, continuously and progressively forming workpieces as they revolve about a central column together with the work spindles and the operating shafts for the forming tools. Work spindles, and tool operating shafts for mounting tools are supported with their axes aligned parallel to the central column and the work spindles are coupled to driving means for individual rotation on their respective axes. A cam affixed to the central column causes the operating shafts to be displaced as they revolve about the central column so as to move the forming tools parallel to the spindle axes. The operating shafts are also each connected to variable driving means for rotating the shafts with variable force so as to accommodate size and shape variations in the work product. Additional stationary tools at the perimeter of the revolving assembly provide secondary operations such as beading permitting a number of operations previously performed separately to be handled in one continuous process on the same machine.

Thus it is an object of the invention to provide a novel multiple-spindle, metal-spinning machine.

It is a further object of the invention to provide a multiple-spindle, metal-spinning machine incorporating a novel tooling arrangement whereby tool forces and tool positions are easily changed and regulated so that a broad range of work products having different shapes and constituent materials can be produced continuously and automatically.

It is a further object of the invention to provide a novel method of applying forming tools in a metal-spinning operation.

Further objects and features of the invention will become apparent upon reading the following description together with the Drawing.

Figure 1:
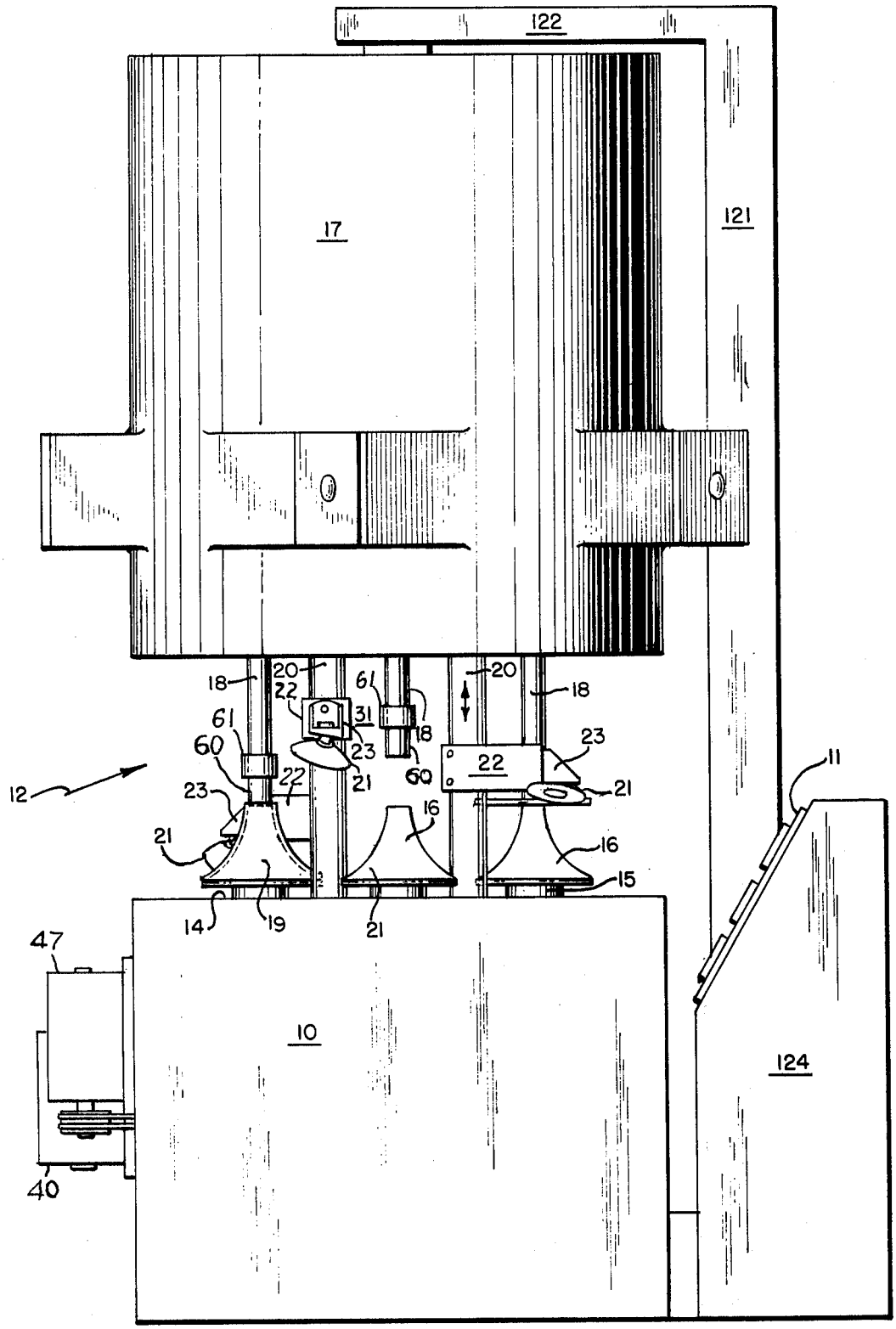
FIG. 1 is a front elevation of an automatic metal-spinning machine according to the invention.

DESCRIPTION OF THE PREFERRED EMBODIMENT:

FIG. 1 depicts a machine for forming metal articles by the spinning process of metal forming. The machine in FIG. 1 has base 10 enclosing part of the drive assembly of the machine, control panel 11 controlling operation of the machine, and rotating carrier assembly 12. Table 14 (FIG. 2), part of carrier assembly 12, carries work spindles 15. Work spindles 15, each rotatable on its own axis, carry work mandrels 16 which determine the shape of workpieces to be formed. Upper housing 17, of carrier assembly 12, encloses the supports and operational apparatus for hold-down rods 18 and tool operating shafts 20, one set for each of the work spindles. The apparatus depicted in FIG. 1 has four work spindles 15 (three shown), four hold-down rods 18 (three shown) and four tool operating shafts 20 (two shown). Operating shafts 20 are mounted for rotation and reciprocation to move tools 21 against workpieces 19. Hold-down rods 18 are positioned in centered opposition to work spindles 15 so that they can clamp workpieces 19 against mandrels 16 on spindles 15. Operating shafts 20 each support tool support arm 22 and tool mounting block 23 holding tool 21 and can both reciprocate and rotate in order to hold and move tools 21 against their respective workpieces. The arrangement for operation of these various assemblies can be better understood with reference to FIG. 2.

Figure 2:
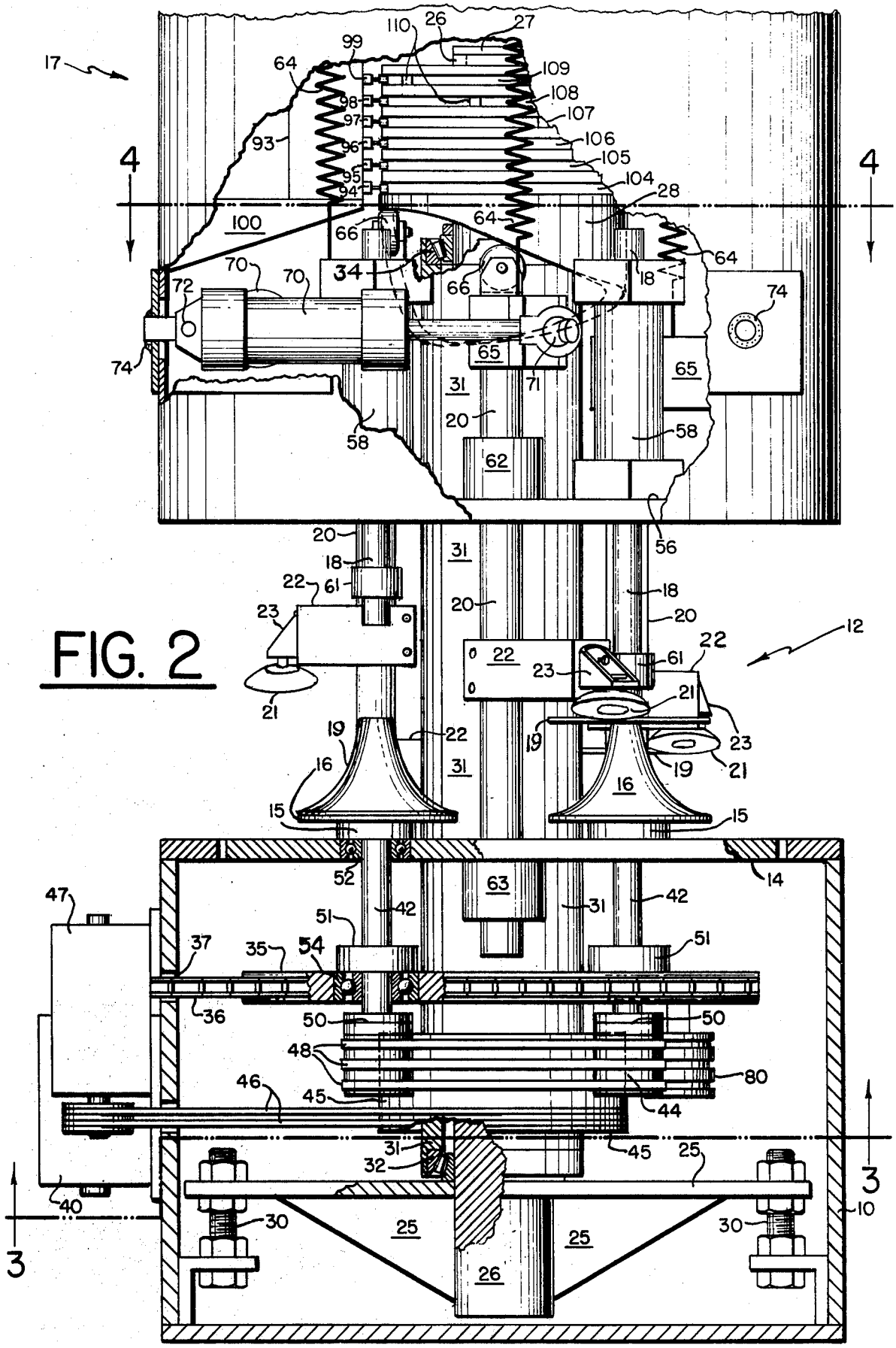
FIG. 2 is a front elevation partly cut away of the machine of FIG. 1.

FIG. 2 shows the housings cutaway and some of the working parts sectioned to detail the operational parts and construction of the inventive machine. Thus base 10 is shown to contain structural support 25 for central column 26. Central column 26 is a rigid column extending from the bottom of base 10 up through carrier assembly 12 nearly to the top of upper housing 17 to clamp cap 27 holding cam 28. Central column 26 is secured to structural support 25 by welding or by other suitable means, and structural support 25 is mounted within base 10 by adjustable bolts 30 for centering or by other usual fixed or adjustable mounting means. Rotatable sleeve 31 is mounted concentrically on the exterior of column 26 supported by bearings 32 and 34. Bearing 32 supports the bottom of sleeve 31 adjacent to structural support 25. Bearing 34 supports the upper end of sleeve 31 where central column 26 passes out through sleeve 31 below clamp cap 27. Bearings 32 and 34 are depicted as tapered roller bearings, but other bearing arrangements can be used.

Rotatable carrier assembly 12 consists of center sleeve member 31 extending from bearing 32 in base 10 up to bearing 34 near the top of support column 26 and all the components mounted therefrom. Sprocket 35, table 14 and plate 56 are welded to sleeve 31 providing driving means and support for the various work-holding and tool-operating mechanisms all part of assembly 12 and constituting an integral operating unit.

It is to be noted that, while the preferred embodiment as described herein is arranged vertically, the present machine could be readily adapted to a horizontal position with column 26 in a horizontal plane.

Ring sprocket 35 is secured to sleeve 31 above support 25 within base 10. Chain 36 passing through aperture 37 in base 10 is connected to further sprocket 38 (See FIG. 3) on main drive motor 40. Thus, operation of drive motor 40 rotates sleeve 31. While the drive connection is shown as chain 36, connecting gears or belts could be used as well as a chain.

At the top of base 10, connected to sleeve 31, is horizontal table 14 carrying four work spindles 15.

While the described apparatus has four work spindles, the number of work spindles is not critical and there could be fewer or considerably more in one machine. Work spindles 15 are mounted in table 14 for rotation about their vertical axes. While the operative portions of work spindles 15 are above the plane of table 14, they have rotating shafts 42 that extend down through table 14 and through ring sprocket 35 ending in sheaves 44.

Motor power, driving sleeve 31, causes rotation of entire carrier assembly 12 around the central column. Work spindles 15 are caused to rotate each on its own axis while the rotation of carrier assembly 12 is proceeding. Cam 28 mounted to stationary column 26 bears against the ends of shafts 20 carrying the work tools causing these shafts to reciprocate, during rotation of carrier assembly 12.

Belt drum 45, mounted on sleeve 31 between support 25 and sprocket 35, is driven by belts 46 from spindle drive motor 47. Belt drum 45 is mounted by bearing 49 (FIG. 3) upon sleeve 31 so that it may rotate independently of sleeve 31. Further series of belts 48 pass around sheaves 44 for spindle shafts 42. Belts 48 also loop around driving grooves in belt drum 45 so that rotation of drum 45 provides rotation of spindle shafts 42.

At the top of each sheave 44 is a spindle clutch, 50 (FIG. 2), for connecting and disconnecting sheave 44 from respective spindle shaft 42. Mounted from sprocket 35 is spindle brake 51 on each spindle shaft 42 for halting rotation when sheave 44 is released by clutch 50. Each spindle shaft 42 is mounted in bearing 52 at table 14 and bearing 54 at sprocket 35.

Plate 56 is mounted rigidly on sleeve 31 spaced above and parallel with table 14 leaving the work area in between. Plate 56 forms the bottom of upper housing 17 and acts as a supporting platform.

Inside housing 17, four pneumatic two-way cylinders 58 carry hold-down rods 18 which pass down through apertures in plate 56 to meet in direct opposition with mandrels 16 mounted on work spindles 15. Terminal portion 60 of each of hold-down rods 18 is supported separately by freely rotating bearing mount 61 so that terminal portion 60 upon clamping workpiece 19 against mandrel 16 will freely rotate or stop rotation as the forming mandrel rotates or stops. Also mounted within housing 17 passing through plate 56 are the upper portions of four operating shafts 20. Operating shafts 20 are mounted both for rotation and reciprocation in bearings 62 secured to plate 56 and further bearings 63 secured to table 14. The upper end of each operating shaft 20 carries a roller, 66, which rides against cam 28. Springs 64 connected to crank arms 65 (extending laterally from the upper portion of each operating shaft 20), maintain upward tension on the respective operating shaft 20 to keep roller 66, against cam 28. Springs 64 are depicted as extension springs with an upper end connected to hooks (not shown) on housing 17 so as to maintain upward tension on shafts 20 through the full travel up and down required for the movement of tools 21 during a spinning operation.

Figure 4:
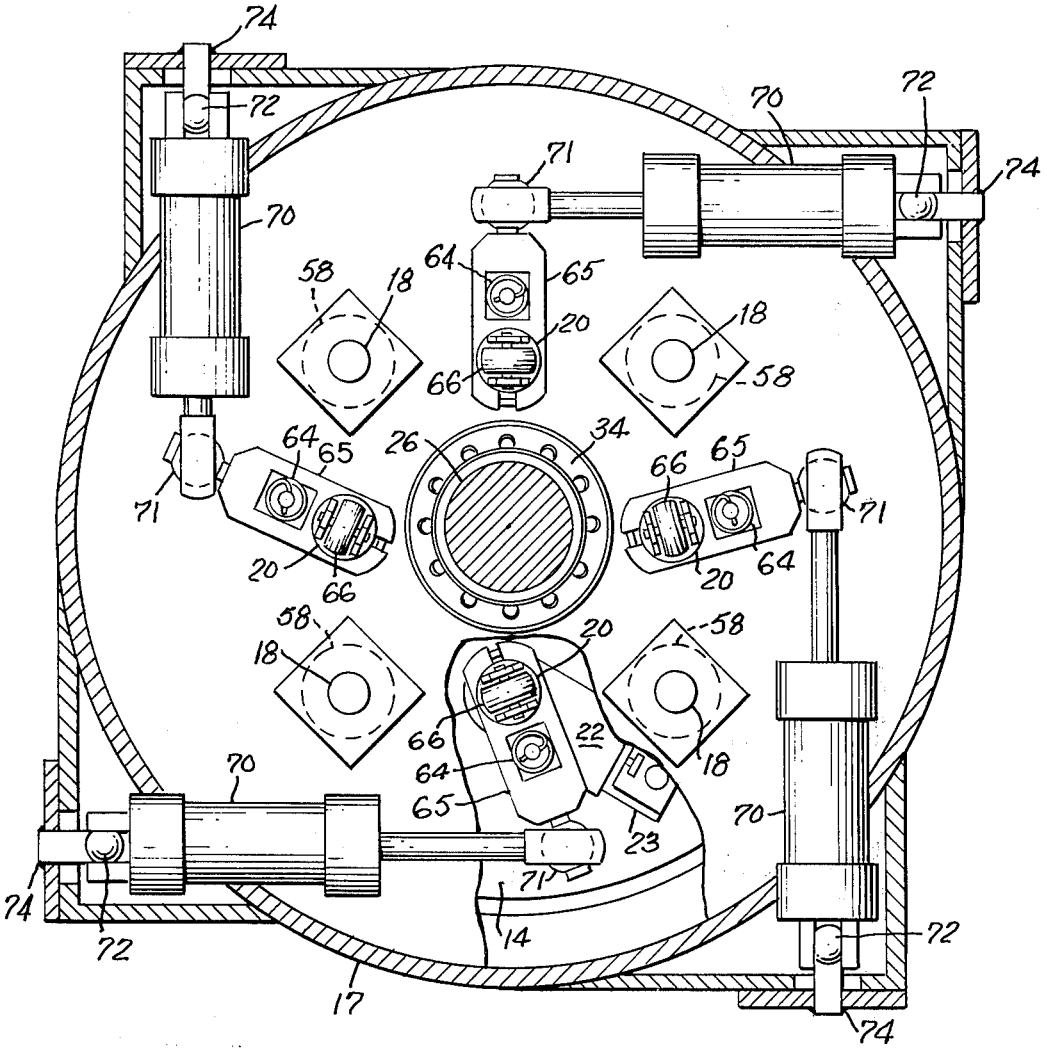
FIG. 4 is a sectional view taken along 4—4 of FIG. 2.

Referring now to FIGS. 2 and 4, two-way pneumatic cylinder 70 is connected at pivotal bearing joint 71 to arm 65 extending at right angles from operating shaft 20. Pneumatic cylinder 70 is supported by pivotal connection 72 which in turn is mounted from cylindrical housing 17 by weld joint 74. Tool support arm 22 is adjustably mounted on operating shaft 20 in between table 14 and plate 56. Arm 22 is terminated by mounting block 23 which has an adjustable connection to tool 21 allowing tool 21 to be adjusted to a position best suited to the particular workpiece.

Figure 3:
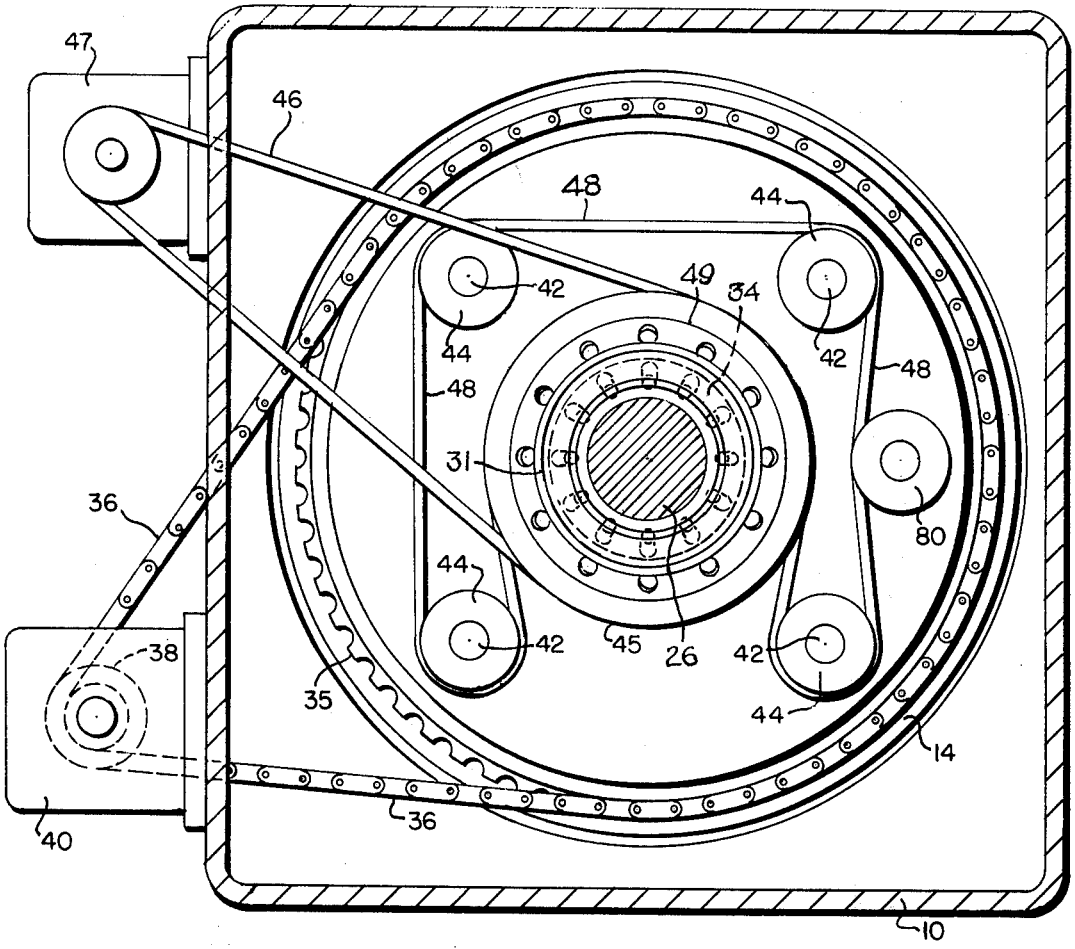
FIG. 3 is a sectional view taken along 3—3 of FIG. 2.

FIG. 3 is a diagramatic view of the drive system showing central column 26, bearing 49 between sleeve 31 and belt drum 45, and belts 46 driving belt drum 45 from spindle drive motor 47. Belt drum 45 has an additional series of grooves (FIG. 2) carrying belts 48 which pass about a portion of drum 45 and then to quadruple sheaves 44 in sequence. Idler wheel 80 is tensioned against belts 48 to take up slack.

The control system for the multi spindle spinning machine may be pneumatic, hydraulic, electric or some combination of these. For example, using pneumatic power for cylinders 58 and 70, valves for actuating cylinders 58 and 70 can be operated electrically or pneumatically. Both electrically and pneumatically operated valves are readily available as are electrical and pneumatic switches.

Figure 5:
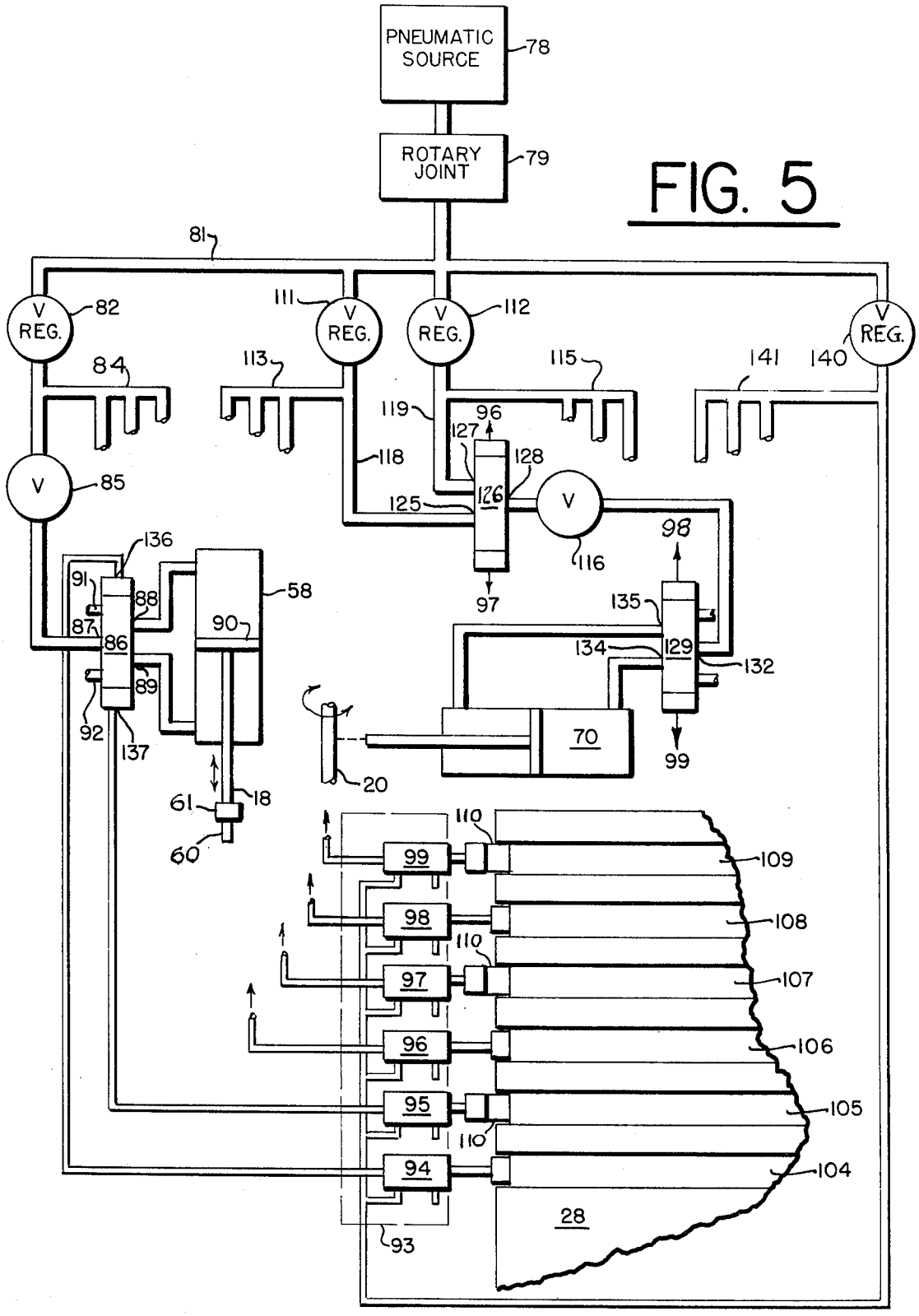
FIG. 5 is a schematic diagram of a control system for the machine of FIG. 1.

FIG. 5 depicts a fluid control system and such a system has been built using pneumatics. The control system of FIG. 5 performs two basic operations. It actuates hold-down rods 18 in reciprocation for clamping and unclamping workpieces. It also actuates shafts 20 in rotation for pressing forming tools 21 against the workpieces. In FIG. 5, a source of air pressure is depicted as pneumatic source 78. Pressure from source 78 is coupled to supply line 81 through rotary joint 79. Pressure regulator 82 is connected to supply line 81 to provide pneumatic pressure for operating hold-down rods 18.

Pneumatic details for only one of hold-down rods 18 is depicted, parallel line branches 84, connected from regulator 82, supply regulated air for rods 18. Following regulator 82 in each branch is manual shutoff valve 85. Shutoff valve 85 permits selective deactivation of individual hold-down rods, 18.

Following valve 85 is valve 86, a four-way, two position-detent, pilot-operated valve. Port 87 of valve 86 is the inlet port while ports 88 and 89 are switchable as alternative outlet ports. When the passage between ports 87 and 88 is open, piston 90 of cylinder 58 extends rod 18 clamping workpiece 19 between terminal end 60 and mandrel 16 (FIG. 1 and FIG. 2). When the open passage is switched to port 89, hold-down rod 18 is retracted, unclamping workpiece 19. Ports 91 and 92 connect ports 88 and 89 respectively to exhaust when they are disconnected from inlet.

Valve 86 is operated by a switching control driven in accordance with the rotational position of carrier 12. While there are many ways this can be done, a cam arrangement is depicted in FIG. 2.

Relay unit 93 is depicted mounted from housing 17 by support bracket 100. Projecting from unit 93 are sensors 94-99. Mounted in circumferential channels 104-109 around the outside cylindrical surface of fixed cam 28 are adjustable camming devices 110. There is a channel for each of sensors 94-99. Each channel carries one or more of camming devices 110 which may be adjustably positionable around their respective channels in conventional manner.

To provide pressure at different levels for rotation of operating shafts 20, a plurality of pressure regulators may be used. FIG. 5 depicts two pressure regulators, 111 and 112 connected from supply line 81 and adjusted to provide different regulated pressures.

Regulator 111 connects regulated fluid pressure to four branch circuits 113. Regulator 112 connects regulated fluid pressure to branch circuits 115. One branch 118 from branch circuits 113 and one branch circuit 119 from branch circuits 115 are described. The other branch circuits being similar.

Branch circuit 118 connects to selectable port 125 of three-way two position-detent, pilot-operated valve 126. Branch circuit 119 connects to selectable port 127 of valve 126. Thus outlet port 128 of valve 126 will have different selectable pressures supplied to it by either of ports 125 or 127 dependent upon the position of valve 126. The position of valve 126 may be changed during forming of a workpiece to coincide with varying forming needs.

Following port 128 is manual shut off valve 116. Shut off valve 116 permits selective deactivation of individual operating shafts 20.

Following valve 116 is valve 129, a four-way, two position-detent, pilot operated valve with one inlet port 132. Two selectable outlet ports 134 and 135 connected to extend and retract ends respectively of pneumatic cylinder 70. When passage between ports 132 and 134 is open, the piston of cylinder 70 extends and, by way of cross arm 65, rotates operating shaft 20 pressing tool 21 against workpiece 19 (FIG. 2 and FIG. 4). When the through passage of valve 129 is switched to selectable port 135, the piston of cylinder 70 retracts and removes tool 21 from workpiece 19. Ports 134 and 135 connect to respective exhaust ports when disconnected from inlet port 132. The through path of valve 129 is switchable by relay unit 93. The through path of valve 126 is also switched by relay unit 93 and exemplary switching mechanism suitable for both functions is depicted. The depicted mechanism is exemplary of pneumatic switching relays that can be utilized in relay unit 93.

In the pneumatic circuit of FIG. 5, each of valves 86, 126 and 129 is switched between two operative conditions by a pair of cam actuated sensors. Valve 86 has pilot operator connections 136 and 137 connected with pneumatic sensors 94 and 95 (three-way, two position, cam operated valves). Pilot operating pressure is supplied to sensors 94-99 in relay unit 93 by regulator 140. Branch circuits 141 connect pilot pressure to four relay units 93. Camming devices 110 in channels 104 and 105 cause pneumatic sensors 94 and 95 to provide pressure pulses to pilot connections 136 and 137 causing valve 86 to switch. Valve 86 will remain in the last condition until a camming device, 110, in the other channel switches the valve to its other condition. Valves 126 and 129 are switched in like manner.

Sensors 94 through 99 may just as easily be electric microswitches connected to solenoid drivers for operating valves 86, 126 and 129.

FIG. 5 shows the details for only one set of valves, 86, 126, 129, whereas there are three additional sets of valves. Three further relay units 93 (not shown) are positioned at 90° intervals about cam 28. Each relay unit provides the control functions relative to a respective work spindle 15 using the same channels 104 through 109 and the same camming devices 110. This works out in proper sequence due to the 90° separations.

In machines where it is desired to operate the several work spindles in different ways it becomes necessary to provide a separate series of channels and camming devices for each work spindle. Thus with four work spindles, 24 channels with their respective camming devices would be necessary. In such a case all the sensors could be arranged in line rather than separated into 90° groups.

By providing most of the control system components inside housing 17, the number of connections that have to be made through rotating joints is minimized. However any switching system that can be made to operate in synchronism with the rotational positions of carrier assembly 12 may be utilized.

Referring once again to FIG. 1, control console 124, supporting control panel 11, is connected by arm 121 to the top of the inventive machine at arm terminal 122. Pneumatic and other connections are made at terminal 122 through rotating joints (not illustrated).

While the invention has been described with relation to a specific embodiment, variations are obvious to those skilled in the art as within the scope of the invention. The machine as described is most simply utilized for single pass shear-spinning, but programming attachments can obviously be applied and are contemplated for multiple-pass complex spinning processes. Likewise the attitude of the machine, the number of spindles, the number of selectable tool pressures, the types of driving energy and related devices are all subject to variations and it is intended to cover the invention as set forth in the appended claims.

We claim:

1. A method of metal spinning comprising:

a. rotating a plurality of rotating mandrels about a common center;

b. clamping work pieces upon said mandrels as a function of the position of said mandrels about said common center;

c. positioning a metal forming tool mounted on a cross arm of a respective reciprocatable rotatable shaft relative to each said mandrel;

d. moving each said shaft in a direction parallel to the axis of rotation of the respective mandrel to cause each said tool to bear against a work piece.

e. rotating each said shaft under a predetermined load pressure to cause each said tool to bear against a work piece in a direction perpendicular to the axis of rotation of the respective mandrel;

f. varying said predetermined load pressure during spinning to accomodate variations in the work to be performed; and, g. effecting said clamping, positioning, moving, rotating and varying as a function of the position of said mandrels about said common center.

2. A method of metal-spinning according to claim 1 wherein said rotating said shaft under a predetermined load pressure comprises rotating said shaft by a fluid actuator and said predetermined load pressure is determined by selection of a fluid pressure regulator.

3. A method of metal-spinning according to claim 2 wherein said moving each said shaft comprising positive mechanical displacement of said shaft by a cam surface.

4. A method of metal spinning according to claim 3 wherein said selection of a fluid pressure regulator is a plurality of selections of a plurality of fluid pressure regulators and each selection is made as a function of rotational position of a respective one of said plurality of mandrels about said common center.

* * * * *